United States Patent [19]

Meisberger

[11] 4,194,080

[45] Mar. 18, 1980

[54] UTILITY LINE SUPPORT STRUCTURE

[75] Inventor: Raymond F. Meisberger, West Chester, Pa.

[73] Assignee: Bruce-Lake Company, Coatesville, Pa.

[21] Appl. No.: 897,044

[22] Filed: Apr. 17, 1978

[51] Int. Cl.[2] ..... E04H 12/24; E04H 12/10; H02G 7/20

[52] U.S. Cl. ..... 174/45 R; 52/40; 52/649; 52/697; 52/721

[58] Field of Search ..... 52/40, 649, 697, 720, 52/721; 174/43, 45, 149

[56] References Cited

U.S. PATENT DOCUMENTS

| | | | |
|---|---|---|---|
| 2,046,152 | 6/1936 | Dean | 52/721 X |
| 3,196,990 | 7/1965 | Handley | 52/40 X |
| 3,203,660 | 8/1965 | Bowden | 52/697 X |
| 3,337,677 | 8/1967 | Milow | 52/697 X |
| 3,649,740 | 3/1972 | Boyer et al. | 52/697 X |

FOREIGN PATENT DOCUMENTS

| | | | |
|---|---|---|---|
| 27155 | of 1912 | United Kingdom | 52/697 |

*Primary Examiner*—J. Karl Bell

*Attorney, Agent, or Firm*—Harding, Earley & Follmer

[57] ABSTRACT

A utility line Y support structure having a tubular pole adapted to be erected to extend upright from the ground, a pair of Y arms extending upwardly and outwardly from the top of the pole, connector means connecting the bottom of the Y arms to the top of the pole, and a crossarm connected between the upper portions of the Y arms, the Y arms being constructed of a structural element having a generally C-shaped cross-section, and the crossarm comprising a truss with lattice work.

9 Claims, 6 Drawing Figures

UTILITY LINE SUPPORT STRUCTURE

BACKGROUND OF THE INVENTION

To support utility lines, for example, 345 KV power lines, it is conventional to use single pole structures, Y structures, H frame structures, and/or lattice steel towers.

Conventional utility line support structures may be made of tubular metal sections, wood, angle iron, or concrete. The concrete may be solid or tubular, and may be reinforced, post-tensioned, or pre-stressed.

Many conventional Y structures and H frame structures are made of tubular pole sections. Tubular pole sections are expensive. Not only are the tubular poles themselves expensive, but the connecting boxes between tubular stems and arms are also expensive because they terminate a stem tube section with a square section in order to make a bolted connection with a square section that terminates the tube section of the arms.

One reason that closed sections such as tubes are expensive is because welding adjacent tube sections together to make a long pole requires using circumference welds that are difficult to make and require careful inspection and a high degree of quality control.

However, a closed section is desirable in utility line supports because it has a great deal of strength and torsional stability.

On the other hand, an open section, such as a channel, is easier and less expensive to manufacture, and is easier to work with in the field when installing it to form utility line support structures. Also, channel sections are easy to butt weld together with easily inspected welds.

In a Y support structure, it is a problem to connect a tubular stem or column to tubular Y arms. It is conventional to make the connection by using an expensive bolted connection in the form of a shaped box made from flat plate.

Tubular steel poles compete with wooden poles as support structures for utility lines. While tubular steel poles are comparatively more expensive than wooden poles, tubular steel poles cost less to erect than the wooden ones.

Lattice steel towers are also used to support utility lines and are expensive to erect due to the many pieces and also because they require four foundations precisely placed with respect to each other. Moreover, lattice steel towers are very rigid and do not deflect under load. If something happens to a utility line to suddenly increase the load, such as a wire breaking or ice falling off of one span but not the other, the tower either supports the load or it fails. On the other hand, tubular support structures have the advantage of deflecting when subjected to an increased load, thereby reducing the imbalance and the possibility of their falling down.

In at least one instance, 60 miles of power line and its supporting lattice steel towers cascaded down, one after the other, because the rigid towers could not deflect and withstand the increased load.

The various rolled shapes available as structural elements for utility line support structures, such as a rolled "I" beams and channels, have not been acceptable to the utility companies because they are not economical or efficient from a strength viewpoint. Accordingly, there is a need for a utility line support structure that is economical and has a high strength to weight ratio.

Acknowledgement is made of the following prior art patents: U.S. Pat. Nos. 709,554; 1,877,583; 2,066,419; 2,136,122; 3,034,209; 3,054,482; 2,659,270; 3,713,262; French Pat. No. 673,690; 747,235; 801,895; British Pat. No. 263,116.

SUMMARY OF THE INVENTION

It is an object of the invention to provide a utility line support structure in the form of a Y structure comprising Y arms constructed of an open structural element having a generally C-shape. The advantages of this Y structure are a low cost of manufacture, a good strength to weight ratio, a provision of flat surfaces for ease of attachment, and a provision of structural elements that require no cutting in the making of the Y structure.

The above advantages are achieved by the provision of a utility line support structure having a tubular pole adapted to be erected so as to extend upright from the ground, a pair of Y arms extending upwardly and outwardly from the top of the pole, each of Y arms comprising a structural element having a web, a pair of side walls extending at right angles to the web from the edges of the web, and a pair of inturned flanges extending at right angles from the outer edges of the side walls, with the flanges being parallel to the web and having edges defining an open slot therebetween, connector means connecting the bottom of the Y arms to the top of the pole, and a crossarm connected between the upper portions of the Y arms.

It is another object of the invention to provide an improved connector for the Y arms on the top of the pole. The connector of the invention is constructed so that it may be set down over top of the tubular pole that forms the stem of the Y structure. The connector is welded, and there is no large box which is conventionally necessary in order to connect the Y arms to the tube of the stem. Also, because the Y arms are of a C-shaped channel construction, they may be attached to the connector using only two bolts, making a very simple and easy connection.

Another object of the invention is to provide an improved Y structure for a utility line support structure which includes all the advantages resulting from the combination of a tubular stem, a flange channel C-shaped Y arm, and a lattice truss crossarm. The Y structure of the invention has the advantage of using easily inspected welds to secure the connector to the tubular stem. This advantage is achieved by using a construction such that the connector slides onto the tubular stem with fillet welds being provided wherever the tubular stem makes contact with the connector. Another advantage is that the C-shaped channel Y arms permit the bolting of the Y arms to the connector, a very inexpensive type of connection. Furthermore, the provision of the crossarm made of a lattice truss construction makes it strong and light in weight, and easily attached to the flat surfaces that form the legs of the C-shaped channel Y arms.

The Y structure of the invention has simplified the attractive conventional Y structure while making it more economical. The conventional Y structure is more expensive than competing H frames because all the stresses are funnelled into a single pole, which requires an expensive construction. On the other hand, the Y structure has the advantage over the H frame in that it is more attractive and provides the utility companies or other users of the ground with full use of the right-of-way where the poles are erected, as compared to an H frame which requires more ground area. The structure of the invention achieves all the advantages of conventional Y structures at an economical cost.

DETAILED DESCRIPTION OF THE INVENTION

Figures 1, 2:
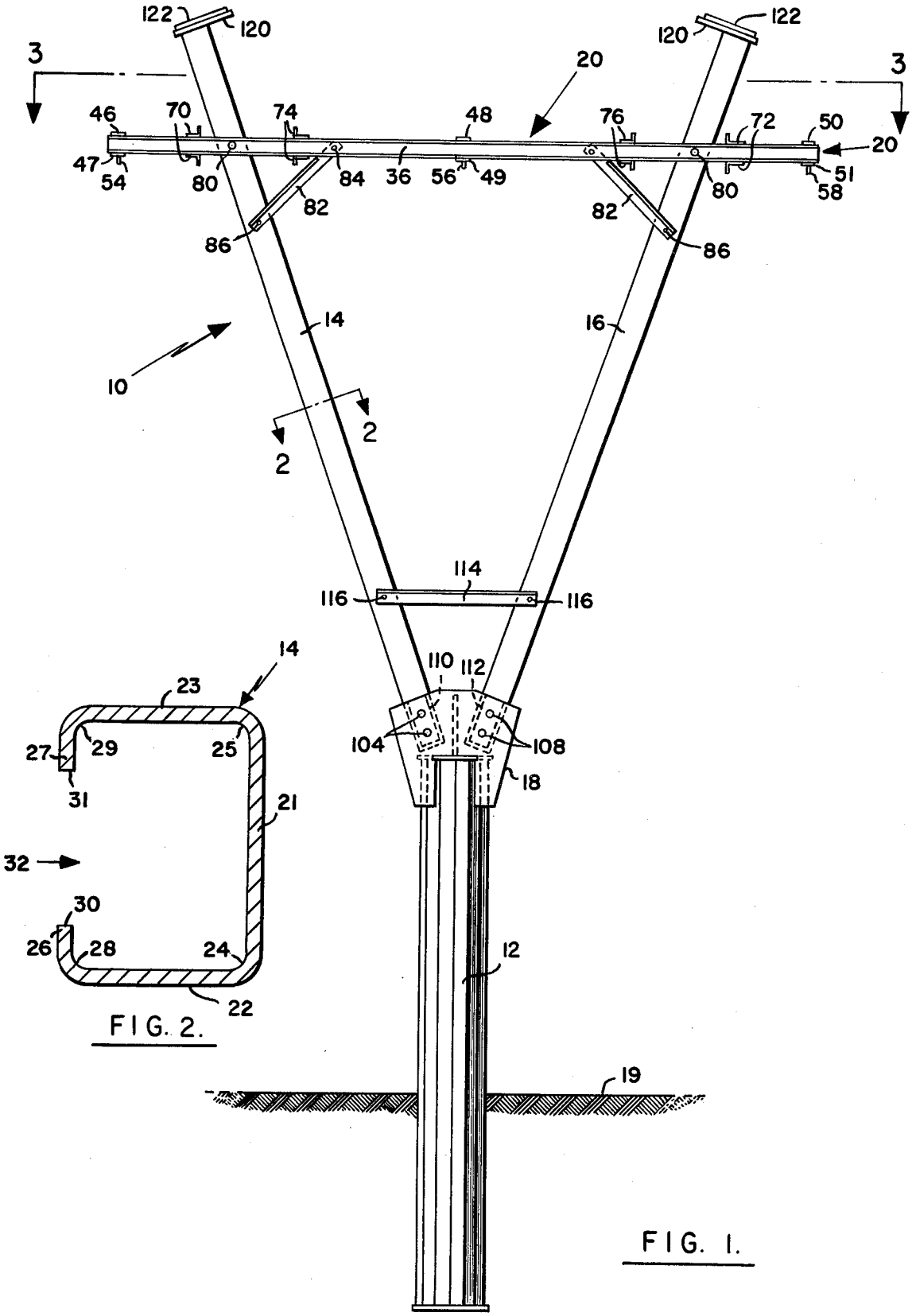
FIG. 1 is a view in front elevation of utility line support structure in accordance with the invention.
FIG. 2 is a view in section taken generally on line 2—2 of FIG. 1.

In FIG. 1 there is shown a metal electric power line support structure in accordance with the invention constructed in the form of a Y structure 10. Y structure 10 comprises a vertical stem formed of a tubular pole 12, a pair of Y arms 14 and 16 extending upwardly and outwardly from the top of pole 12, a connector 18 connecting the bottom of Y arms 14 and 16 to the top of the pole 12, and a crossarm 20 connected between upper portions of Y arms 14 and 16. Pole 12 is made of a twelve-sided tubular steel construction generally conventional in the art and is securely embedded in the ground 19 to extend in an upright position.

Each of the Y arms is made of a structural element in accordance with the invention and illustrated in FIG. 2, and comprises a steel channel having a C-shaped cross-section, including a web 21, a pair of side walls 22 and 23, and a pair of inturned flanges 26 and 27. Side wall 22 extends at right angles from a break line 24 between side wall 22 and web 21 and side wall 23 extends at right angles from a break line 25 between web 21 and side wall 23. Inturned flange 26 extends at right angles from a break line 28 between inturned flange 26 and side wall 22, and inturned flange 27 extends at right angles from a break line 29 between side wall 23 and inturned flange 27. Inturned flanges 26 and 27 are parallel to web 21 and have edges 30 and 31 defining an open slot 32 therebetween.

Y arms 14 and 16 are arranged in the Y structure 10 with their open slots 32 facing outwardly away from each other. Each Y arm 14 and 16 is made from a flat plate having a top edge and a bottom edge that are parallel to each other. The C-shaped Y arms are formed by breaking the flat plate across the longitudinally extending break lines 24, 25, 28 and 29 to form the C-shape shown in FIG. 2. This breaking procedure also forms the slot 32 between the edges 30 and 31.

Figure 3:
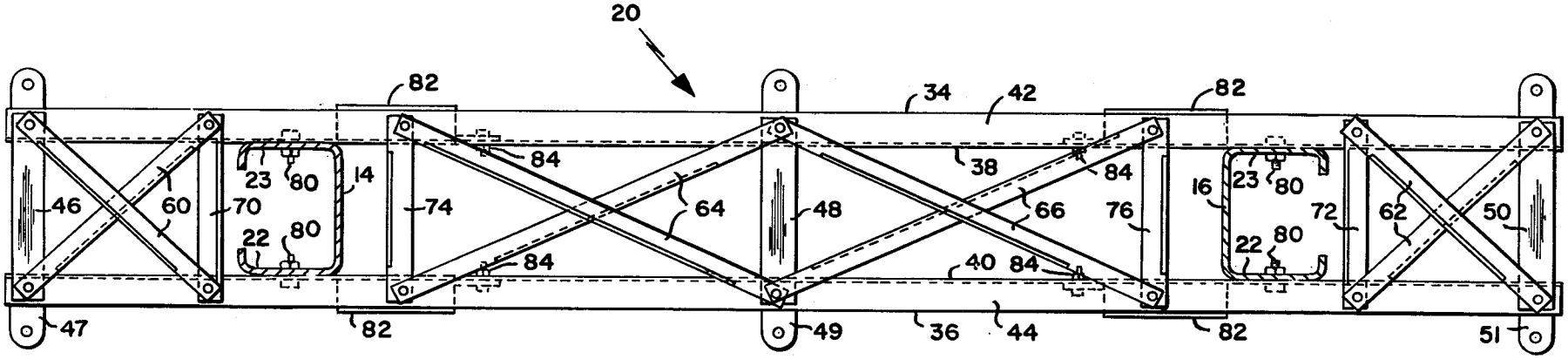
FIG. 3 is a view in top plan showing the crossarm extending between the Y arms and taken generally on line 3—3 of FIG. 1.

Crossarm 20 comprises a truss with lattice work and is shown in detail in top plan in FIG. 3. Crossarm 20 includes a pair of U-shaped channel crossarms 34 and 36 arranged with the web 38 of channel crossarm 34 and the web 40 of channel crossarm 36 back-to-back and spaced apart from each other, and with the flanges 42 of channel crossarm 34 extending away from the flanges 44 of channel crossarm 36. Channel crossarms 34 and 36 are connected together at the ends and center at top flanges 42 and 44 by three flat braces 46, 48 and 50 and at bottom flanges 42 and 44 by three flat braces 47, 49 and 51. Braces 47, 49 and 51 extend beyond channel crossarms 34 and 36 and are provided with downwardly extending connector plates 54, 56 and 58 for use in supporting utility lines.

Channel crossarms 34 and 36 are also connected together at both top and bottom flanges 42 and 44 by a pair of end angle crossbraces 60, a pair of end angle crossbraces 62, a pair of central angle crossbraces 64, a pair of central angle crossbraces 66, an angle crossbrace 70 extending between the ends of crossbraces 60, an angle brace 72 extending between the ends of crossbraces 62, an angle brace 74 extending between the ends of crossbraces 64, and an angle brace 76 extending between the ends of crossbraces 66.

As shown in FIG. 3, the above-described braces and crossbraces are bolted to the outside of the associated flanges 42 and 44 of the channel crossarms 34 and 36 by suitable bolt and nut assemblies. For the sake of clarity of illustration crossbraces 60, 62, 64 and 66 have been omitted from FIG. 1.

Means are provided for connecting the crossarm 20 between upper portions of Y arms 14 and 16 to extend horizontally therebetween. To this end, channel crossarms 34 and 36 embrace Y arms 14 and 16 with crossarm webs 38 and 40 in contact with the side walls 22 and 23 of the Y arms 14 and 16 as shown in FIG. 3, the contacting portions being bolted together by bolts 80. Crossarm 20 is also secured to the Y arms 14 and 16 by four angle braces 82 extending between and secured to webs 38 and 40 of channel crossarms 34 and 36 and side walls 22 and 23 of Y arms 14 and 16. The ends of braces 82 are secured to webs 38 and 40 by bolts 84 and to Y arms 14 and 16 by bolts 86.

Figure 5:
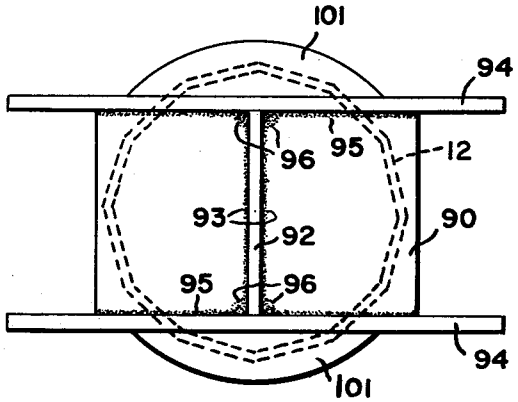
FIG. 5 is a top plan view of FIG. 4.
Figure 4:
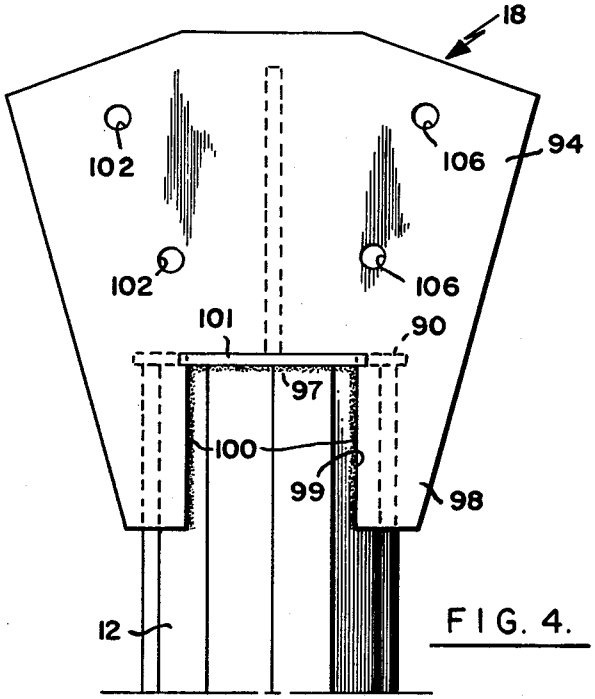
FIG. 4 is a detail view in front elevation of the connection for the Y arms to the top of the pole.

Connector 18 is shown in detail in FIGS. 4 and 5 and comprises a horizontal cover plate 90 covering the top of pole 12, a vertical stiffener plate 92 welded by fillet welds 93 to the top of cover plate 90 and located to divide cover plate 90 into two halves, and a pair of vertical transfer plates 94 welded by horizontal fillet welds 95 to the horizontal edges of cover plate 90 and by vertical fillet welds 96 to the vertical edges of the stiffener plate 92. Each transfer plate has a depending portion 98 extending below cover plate 90 and having a rectangular shaped recess 99 formed therein for receiving the top portion of pole 12.

A pair of arcuate shaped cover plates 101 are provided to enclose the portion of the top of pole 12 extending outwardly of the transfer plates 94. Cover plates 101 are fillet welded to the outer wall of the associated transfer plate 94 to be located in alignment with the cover plate 90.

After connector 18 is mounted on top of pole 12, it is secured in position by welding the edges of each of recesses 99 to pole 12 by vertical fillet welds 100 and by welding the top end of pole 12 to the contacting portions of cover plates 90 and 101 by a fillet weld 97 extending circumferentially around the periphery of the top end of pole 12.

Each transfer plate 94 is provided with a pair of holes 102 adapted to cooperate with bolts 104 for attaching the bottom portion of the side walls of Y arm 14 to transfer plates 94. Each transfer plate 94 is also provided with a pair of holes 106 adapted to cooperate with bolts 108 for attaching the bottom portion of the side walls of Y arm 16 to transfer plates 94.

Y arm 14 is provided at its bottom with a pair of plates 110 welded to the outside of each of the side walls thereof and provided with holes to receive bolts 104. Y arm 16 is provided at its bottom end with a pair of plates 112 welded to the outside of the side walls thereof and provided with holes to receive the bolts 108. Plates 110 and 112 serve to strengthen the bolt attachment to the transfer plates 94. The parts are constructed and arranged so that the Y arms 14 and 16 with the attached plates 110 and 112 sit within the transfer plates 94 to permit this bolting attachment.

A pair of Y arm angle braces 114 extend horizontally between and are connected at their ends to the outside of the side walls of Y arms 14 and 16 by bolts 116. Braces 114 assist the crossarm 20 in maintaining the position of the Y arms 14 and 16.

Figure 6:
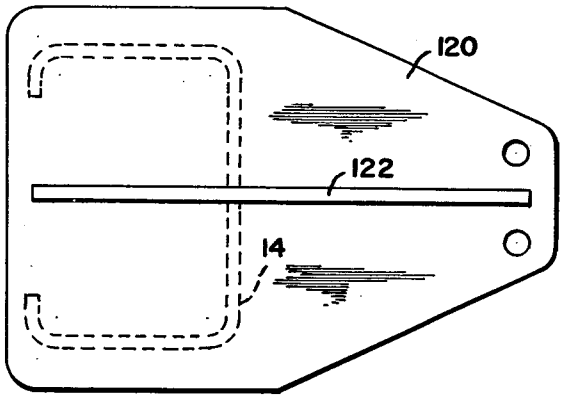
FIG. 6 is a detail view of the top end of a Y arm.

A pair of cover plates 120 are welded onto the top of Y arms 14 and 16 and are shown in detail in FIG. 6. Each cover plate 120 is provided with a stiffening rib 122 extending along the center line thereof, and with a pair of holes at one end adapted for connection to the static wire of the utility line.

I claim:

1. A metal electric utility line support structure for supporting electric power transmission lines, comprising a tubular pole adapted to be erected so as to extend upright from the ground, a pair of Y arms extending upwardly and outwardly from the top of the pole, each of said Y arms comprising a structural element having a web, a pair of sidewalls extending at right angles to said web from the edges of said web, a pair of inturned flanges extending at right angles to said sidewalls from the outer edges of said flanges, said flanges being parallel to the web and having edges defining a slot therebetween, connector means connecting the bottom of the Y arms to the top of the pole, a crossarm connected between the upper portions of the Y arms for supporting electric utility lines therefrom, and including a series of said electric utility line support structures spaced apart from each other in a line, and an electric utility line supported from the crossarms of said series and connected between said support structure of said series along said line.

2. A metal electric utility line support structure for supporting electric power transmission lines, comprising a tubular pole adapted to be erected so as to extend upright from the ground, a pair of Y arms extending upwardly and outwardly from the top of the pole, each of said Y arms comprising a structural element having a web, a pair of sidewalls extending at right angles to said web from the edges of said web, a pair of inturned flanges extending at right angles to said sidewalls from the outer edges of said flanges, said flanges being parallel to the web and having edges defining a slot therebetween, connector means connecting the bottom of the Y arms to the top of the pole, a crossarm connected between the upper portions of the Y arms for supporting electric utility lines therefrom, said connector means including a horizontal cover plate for covering the top of the pole, a vertical stiffener plate welded by fillet welds to the top of the cover plate, a pair of transfer plates welded by fillet welds to the vertical edges of the stiffener plate and the horizontal edges of the cover plate so that a horizontal section through the stiffener and transfer plates forms an H, each transfer plate having a depending portion extending below the cover plate and having a recess formed therein for receiving the top portion of the pole, fillet welds welding the edges of said recess to the pole, and bolt means for attaching the bottom sidewalls of the Y arms to the transfer plates.

3. A metal electric utility line support structure for supporting electric power transmission lines, comprising a tubular pole adapted to be erected so as to extend upright from the ground, a pair of Y arms extending upwardly and outwardly from the top of the pole, each of said Y arms comprising a structural element having a web, a pair of sidewalls extending at right angles to said web from the edges of said web, a pair of inturned flanges extending at right angles to said sidewalls from the outer edges of said flanges, said flanges being parallel to the web and having edges defining a slot therebetween, connector means connecting the bottom of the Y arms to the top of the pole, a crossarm connected between the upper portions of the Y arms for supporting electric utility lines therefrom, said crossarm comprising a truss with lattice work including a pair of channel crossarms positioned with webs back-to-back and spaced apart from each other, and with the flanges of one channel extending away from the flanges of the other channel, said channel crossarms being connected at top and bottom flanges by angle braces and crossbraces, and including bolt means connecting the webs of the channel crossarms to the sidewalls of the Y arms.

4. A metal electric utility line support structure for supporting electric power transmission lines, comprising a tubular pole adapted to be erected so as to extend upright from the ground, a pair of Y arms extending upwardly and outwardly from the top of the pole, each of said Y arms comprising a structural element having a web, a pair of sidewalls extending at right angles to said web from the edges of said web, a pair of inturned flanges extending at right angles to said sidewalls from the outer edges of said flanges, said flanges being parallel to the web and having edges defining a slot therebetween, connector means connecting the bottom of the Y arms to the top of the pole, a crossarm connected between the upper portions of the Y arms for supporting electric utility lines therefrom, said connector means including a horizontal cover plate for covering the top of the pole, a vertical stiffener plate welded by fillet welds to the top of the cover plate and dividing the cover plate into two halves, a pair of transfer plates welded by fillet welds to the vertical edges of the stiffener plate and the horizontal edges of the cover plate so that a horizontal section through the stiffener and transfer plates forms an H, each transfer plate having a depending portion extending below the cover plate and having a recess formed therein for receiving the top portion of the pole, fillet welds welding the edges of said recess to the pole, bolt means for attaching the bottom sidewalls of the Y arms to the transfer plates, and said crossarm comprising a truss with lattice work including a pair of channel crossarms positioned with webs back-to-back and spaced apart from each other, and with the flanges of one channel extending away from the flanges of the other channel, said channel crossarms being connected at top and bottom flanges by angle braces and crossbraces, and bolt means connecting the webs of the channel crossarms to the sidewalls of the Y arms.

5. The metal electric utility line support structure of claim 4 including a fillet weld welding the top of said tubular pole to said cover plate and extending circumferentially around the top of said pole.

6. The metal electric utility line support structure of claim 4 wherein said pair of side walls of said structural element extend at right angles to said web from a break line between said web and each side wall, and said pair of inturned flanges extend at right angles from a break line between each flange and its associated side wall.

7. A metal electric utility line support structure for supporting electric power transmission lines, comprising a tubular pole adapted to be erected so as to extend upright from the ground, a pair of Y arms extending upwardly and outwardly from the top of the pole, connector means connecting the bottom of the Y arms to the top of the pole, and a crossarm connected between the upper portions of the Y arms, said crossarm comprising a truss with lattice work including a pair of channel crossarms positioned with webs back-to-back and spaced apart from each other, and with the flanges of one channel extending away from the flanges of the other channel, said channel crossarms being connected at top and bottom flanges by angle braces and crossbraces, and means connecting the webs of the channel crossarms to the Y arms.

8. A metal electric utility line support structure according to claim 7 wherein said connecting means includes bolt means for connecting the webs of the channel crossarms to the side walls of the Y arms.

9. A metal electric utility line support structure for supporting electric power transmission lines, comprising a tubular pole adapted to be erected so as to extend upright from the ground, a pair of Y arms extending upwardly and outwardly from the top of the pole, each of said Y arms comprising a structural element having a web, a pair of sidewalls extending at right angles to said web from the edges of said web, a pair of inturned flanges extending at right angles to said sidewalls from the outer edges of said flanges, said flanges being parallel to the web and having edges defining a slot therebetween, connector means connecting the bottom of the Y arms to the top of the plate, said connector means including a pair of vertical flat transfer plates, bolt means for attaching the sidewalls of the Y arms to the transfer plates, and a crossarm connected between the upper portion of the Y arms for supporting electric utility lines therefrom.

* * * * *